US007971407B2

(12) United States Patent
MacDonald

(10) Patent No.: US 7,971,407 B2
(45) Date of Patent: Jul. 5, 2011

(54) WALL BLOCK AND WALL BLOCK SYSTEM FOR CONSTRUCTING WALLS

(75) Inventor: Robert A. MacDonald, Plymouth, MN (US)

(73) Assignee: Keystone Retaining Wall Systems, Inc., Bloomington, MN (US)

( * ) Notice: Subject to any disclaimer, the term of this patent is extended or adjusted under 35 U.S.C. 154(b) by 338 days.

(21) Appl. No.: 12/124,311

(22) Filed: May 21, 2008

(65) Prior Publication Data

US 2008/0289282 A1 Nov. 27, 2008

Related U.S. Application Data

(60) Provisional application No. 60/931,137, filed on May 21, 2007.

(51) Int. Cl.
*E04C 3/22* (2006.01)
*E04C 3/20* (2006.01)

(52) U.S. Cl. ..... 52/568; 52/379; 52/598; 52/605; 52/604

(58) Field of Classification Search ..... 52/604, 52/612, 102, 381, 245, 603, 605, 379, 598, 52/601, 568, 572; 405/284, 286
See application file for complete search history.

(56) References Cited

U.S. PATENT DOCUMENTS

| | | | | |
|---|---|---|---|---|
| 9,715 A | | 6/1836 | Mott | |
| 16,486 A | | 1/1857 | Johnson | |
| 205,832 A | * | 7/1878 | Brown | 52/102 |
| 348,598 A | * | 9/1886 | Strickland | 52/102 |
| 1,115,542 A | * | 11/1914 | Hudson | 52/245 |
| 1,293,898 A | * | 2/1919 | Parmley | 52/600 |
| 2,034,851 A | | 7/1934 | Wichmann | |
| 2,094,167 A | | 9/1937 | Evers | |
| 2,127,914 A | * | 8/1938 | Hadland | 138/115 |
| 2,141,397 A | * | 12/1938 | Locke | 52/204.2 |
| 2,201,110 A | * | 5/1940 | Makram | 52/566 |
| 2,963,828 A | | 6/1957 | Belliveau | |
| 2,833,532 A | * | 5/1958 | Ries | 165/9.1 |
| 3,036,407 A | | 5/1962 | Dixon | |
| 3,298,668 A | | 1/1967 | Schueren | |
| 3,791,090 A | * | 2/1974 | Kniefel | 52/590.2 |
| 3,888,060 A | | 6/1975 | Haener | |

(Continued)

FOREIGN PATENT DOCUMENTS

DE 296 02 741 U1 4/1996

(Continued)

OTHER PUBLICATIONS

Abstract for FR 2 583 088 A1 (1 page).

(Continued)

*Primary Examiner* — Phi Dieu Tran A
(74) *Attorney, Agent, or Firm* — Popovich, Wiles & O'Connell, P.A.

(57) ABSTRACT

Wall blocks and methods of constructing walls from the wall blocks which have a side connection system interlocking adjacent blocks whereby a side of the block is provided with a channel or slot that is configured to engage a corresponding projection on the adjacent block. The side connection system may alternatively have a connection receiving cavity formed by channels or slots on the sides of the blocks which are configured to align with a channel or slot from adjacent blocks where a connector may be received to interlock the blocks.

7 Claims, 6 Drawing Sheets

U.S. PATENT DOCUMENTS

| | | | | |
|---|---|---|---|---|
| 3,936,987 | A | 2/1976 | Calvin | |
| 3,936,989 | A | 2/1976 | Hancock | |
| 4,075,812 | A * | 2/1978 | Koyama et al. | 52/747.13 |
| 4,107,894 | A | 8/1978 | Mullins | |
| 4,115,980 | A * | 9/1978 | Martel et al. | 52/590.2 |
| 4,124,961 | A | 11/1978 | Habegger | |
| 4,175,888 | A | 11/1979 | Ijima | |
| 4,186,540 | A | 2/1980 | Mullins | |
| 4,262,463 | A | 4/1981 | Hapel | |
| 4,314,431 | A | 2/1982 | Rabassa | |
| 4,426,815 | A | 1/1984 | Brown | |
| 4,565,043 | A | 1/1986 | Mazzarese | |
| 4,640,071 | A | 2/1987 | Haener | |
| 4,651,455 | A | 3/1987 | Geiser, Jr. | |
| 4,726,567 | A | 2/1988 | Greenberg et al. | |
| 4,769,961 | A * | 9/1988 | Gillet | 52/245 |
| 4,887,403 | A | 12/1989 | Bonner | |
| 5,114,270 | A * | 5/1992 | Riddle | 405/15 |
| 5,283,994 | A * | 2/1994 | Callison | 52/71 |
| 5,308,195 | A | 5/1994 | Hotek | |
| 5,575,128 | A | 11/1996 | Haener | |
| 5,623,797 | A | 4/1997 | Gravier et al. | |
| 5,633,508 | A | 5/1997 | Schleppenbach | |
| 5,651,642 | A * | 7/1997 | Kelley et al. | 405/286 |
| 5,685,119 | A * | 11/1997 | Zschoppe | 52/592.5 |
| 5,761,861 | A | 6/1998 | Brackett | |
| 5,934,035 | A | 8/1999 | Rasmussen et al. | |
| 6,065,265 | A | 5/2000 | Stenekes | |
| 6,176,049 | B1 | 1/2001 | Crant et al. | |
| 6,185,888 | B1 | 2/2001 | Wasson | |
| 6,189,282 | B1 * | 2/2001 | VanderWerf | 52/582.1 |
| 6,192,629 | B1 | 2/2001 | Akins et al. | |
| 6,374,556 | B2 | 4/2002 | Crant et al. | |
| 6,398,193 | B1 | 6/2002 | DeSouza | |
| 6,564,524 | B1 | 5/2003 | Gruita | |
| 6,571,521 | B1 | 6/2003 | Ameigh | |
| 6,578,338 | B1 | 6/2003 | Nanayakkara | |
| 6,735,913 | B2 | 5/2004 | Sanders et al. | |
| 6,782,673 | B2 | 8/2004 | Azar | |
| 6,862,856 | B2 | 3/2005 | Turgeon-Schramm et al. | |
| 6,907,404 | B1 | 6/2005 | Li | |
| 6,912,823 | B2 * | 7/2005 | MacDonald et al. | 52/574 |
| 6,948,282 | B2 * | 9/2005 | Bott | 52/98 |
| 7,037,047 | B1 | 5/2006 | Tufts et al. | |
| 7,096,635 | B2 | 8/2006 | Price et al. | |
| 7,229,235 | B2 | 6/2007 | Blomquist et al. | |
| RE39,922 | E | 11/2007 | Rainey | |
| 7,694,485 | B1 * | 4/2010 | Siener | 52/590.2 |
| 7,712,281 | B2 * | 5/2010 | Bott | 52/604 |
| 2005/0242468 | A1 | 11/2005 | MacDonald et al. | |
| 2005/0252144 | A1 | 11/2005 | MacDonald et al. | |
| 2005/0252145 | A1 | 11/2005 | MacDonald et al. | |
| 2005/0252146 | A1 | 11/2005 | MacDonald et al. | |
| 2007/0193183 | A1 | 8/2007 | Price et al. | |
| 2008/0172970 | A1 | 7/2008 | MacDonald et al. | |

FOREIGN PATENT DOCUMENTS

| | | | |
|---|---|---|---|
| EP | 0 191 104 | A1 | 8/1986 |
| FR | 1 016 977 | A | 11/1952 |
| FR | 2 558 870 | A1 | 8/1985 |
| FR | 2 583 088 | A1 | 12/1986 |
| FR | 2 592 668 | A1 | 7/1987 |
| FR | 2 705 712 | A1 | 12/1994 |
| JP | 9-187580 | A | 7/1997 |
| WO | WO 99/05370 | A1 | 2/1999 |

OTHER PUBLICATIONS

Abstract for FR 2 592 668 A1 (1 page).

Abstract for JP 9-187580 A (1 page).

Feb. 3, 2006 Search Report for International Application No. PCT/US2005/014675 (14 pages).

Sep. 6, 2005 Notification of Transmittal of the International Search Report and the Written Opinion of the International Searching Authority, or the Declaration in PCT/US2005/014676 (12 pages).

* cited by examiner

Fig. 2A
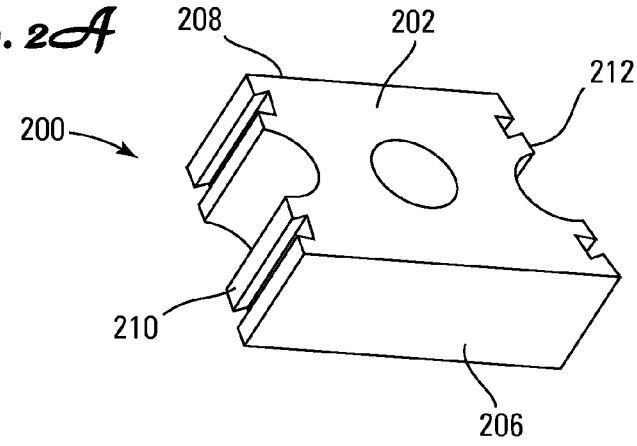
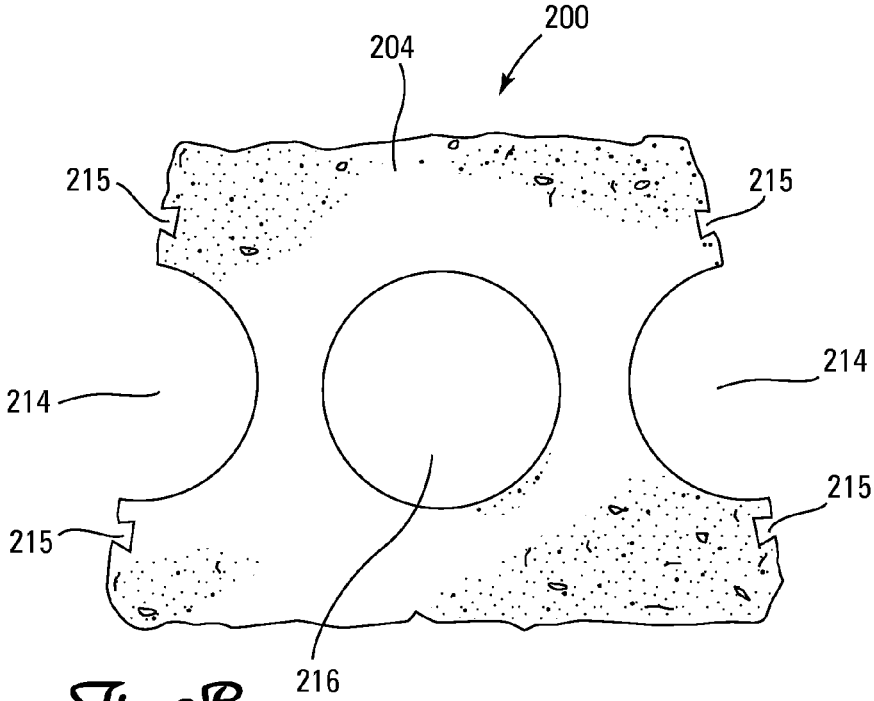
Fig. 2B
Fig. 2C
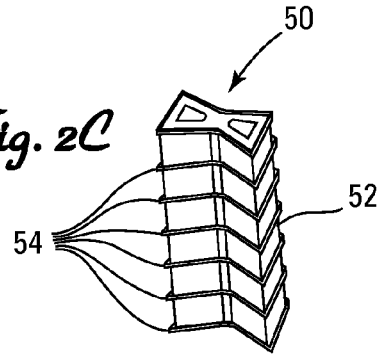

WALL BLOCK AND WALL BLOCK SYSTEM FOR CONSTRUCTING WALLS

This application claims the benefit of U.S. Provisional Application No. 60/931,137, filed May 21, 2007, entitled "Wall Block and Wall Block System for Constructing Walls", the contents of which are hereby incorporated by reference herein.

FIELD OF THE INVENTION

This invention relates generally to wall blocks and walls constructed from such blocks. In particular, this invention relates to wall blocks having cores, interlocking projections and slots, and curvilinear recesses and walls made from such blocks. This invention also relates to wall blocks having cores, curvilinear recesses and a side connection system and the walls made from such blocks.

BACKGROUND OF THE INVENTION

Retaining walls and freestanding walls are used in various landscaping projects and are available in a wide variety of styles. Numerous methods and materials exist for the construction of retaining walls. Such methods include the use of natural stone, poured concrete, precast panels, masonry, and landscape timbers or railroad ties.

In recent years, segmental concrete retaining wall units, which are dry stacked (i.e., built without the use of mortar), have become widely accepted in the construction of retaining walls. An example of such a unit is described in U.S. Pat. No. Re 34,314 (Forsberg). Such retaining wall units have gained popularity because they are mass produced and, consequently, relatively inexpensive. They are structurally sound, easy and relatively inexpensive to install, and couple the durability of concrete with the attractiveness of various architectural finishes. The retaining wall system described in U.S. Pat. No. Re 34,314 (Forsberg) has been particularly successful because of its use of a block design that includes, among other design elements, a unique pinning system that interlocks and aligns the retaining wall units, thereby providing structural strength and allowing efficient installation. This system is advantageous in the construction of larger walls, when combined with the use of geogrids hooked over the pins, as described in U.S. Pat. No. 4,914,876 (Forsberg). However, in smaller walls, for example, walls of three foot height or less this connection system of interlocking pins is unnecessary for wall stability and adds to the cost of the system and complexity of wall construction.

Another important feature of retaining wall blocks and blocks used in free standing walls is the appearance of the block. The look of weathered natural stone is very appealing for walls. There are several methods in the art to produce concrete wall blocks having an appearance that to varying degrees mimics the look of natural stone. One well known method is to split the block during the manufacturing process so that the front face of the block has a fractured concrete surface that looks like a natural split rock. This is done by forming a slab in a mold and providing one or more grooves in the slab to function as one or more splitting planes. The slab is then split apart to form two or more blocks. Another method is wherein blocks are individually formed in a mold and the surfaces are textured by removal of the mold. Additional machine texturing processes can then be applied. Many manufacturers also vary the color and the texture or pattern on the front face of the block. It might be desirable for the face of the block to be smooth, serrated, or grooved or to have an aggregate appearance.

Another method to create a weathered stone appearance is to tumble the blocks together with other blocks in a large rotating canister. The collisions of the blocks in the tumbler chips off random pieces of the blocks, rounding the edges and creating a look that can be quite close to the appearance of a natural stone. This is a labor intensive undertaking that also can result in undesirable damage to the blocks and high overall costs of production.

Many manufacturers also vary the color and the texture or pattern on the front face of the block. It might be desirable for the face of the block to be smooth, serrated, or grooved or to have an aggregate appearance.

Creating a random, or ashlar, pattern in the face of a wall is highly desirable. This gives the appearance of a mortared or dry-stacked natural stone wall, which is a traditional and well accepted look. Some current wall blocks are intended to create an ashlar pattern. However, the creation of a truly random appearance requires the production of multiple block shapes for use in a single retaining wall. This is inefficient from a production standpoint because this requires multiple molds and more kinds of blocks to inventory. If only one face of the block is intended to be the front face, then the block system will suffer a trade-off between having enough face sizes to create a random, natural appearance and the cost and inefficiency of using multiple molds and creating multiple inventory items.

The shape of the block is also an important feature during installation of a retaining wall. Forsberg '876 illustrates a fairly complex shape for a retaining wall block which is particularly advantageous in the construction of curved walls. The block is symmetrical about a vertical plane which bisects the block at a midway point through the front and back faces.

Many commercially available blocks are symmetrical about a plane bisecting the front and back surfaces. Typically such blocks have planes rather than axes of symmetry, as there are differences between the top and bottom surfaces of such blocks. Clearly, blocks that are substantially square or rectangular (i.e., each surface being joined to another at an orthogonal angle) exhibit a great deal of symmetry. Other blocks are more complex in shape and exhibit only one vertical plane of symmetry. For example, U.S. Pat. No. 5,711,130 (Shatley) illustrates a block having substantially parallel front and back faces and non-parallel, mirror-image side wall surfaces. That is, there is a mirror plane of symmetry that vertically bisects the block. U.S. Pat. No. 5,598,679 (Orton et al.) and U.S. Pat. No. 5,294,216 (Sievert) illustrate a type of block having parallel front and back faces and non-parallel, converging side surfaces. The term "converging side surfaces" means that the side walls of the blocks converge as they approach the rear of the block. Such blocks are also symmetrical about a vertical plane that passes through the front and back surfaces.

There are advantages to having non-parallel surfaces on these blocks when constructing a retaining wall. The angles formed by these side surfaces permits construction of curvilinear walls, and moreover, permit the amount of curvature to vary according to the terrain and desired appearance of the wall.

However, problems still remain in the field of retaining walls and free standing walls. Easy-to-use methods and systems that result in safe, stable and cost effective walls are continually sought.

It would be desirable to have a system of blocks for constructing a wall that combines the ability to improve the reinforcement of the wall with the ease of installation of modern segmental walls, while still providing for an attractive appearance of a natural stone wall. The block system should allow the construction of retaining walls, freestanding walls, straight walls, and curved walls.

SUMMARY OF THE INVENTION

The present invention relates to blocks and methods of constructing retaining walls, freestanding walls, straight walls, curved walls and circular walls with the blocks. The blocks have a first face which has a larger surface area than a second face and the blocks may have a side connection system wherein the side of the block is provided with a channel or slot that is configured to engage a corresponding projection on an adjacent block. There may be one or more channels or slots and corresponding projections on the block. A different embodiment of the block provides an alternate side connection system wherein the sides of the block are provided with channels or slots and are configured to align with a channel or slot of an adjacent block forming a connection receiving cavity wherein connectors are received. The blocks may also be provided with circular cores and cavities which overlap in adjacent courses of a wall to form vertical cavities inside the wall. These vertical cavities may be filled with a stabilizing material and along with the side connection system give the wall additional stability, not only between blocks of a course, but also between blocks in adjacent courses.

In one aspect the present invention is a wall block for use in forming a wall from multiple wall blocks, the wall having a front surface and a rear surface, the wall block including opposing and parallel upper and lower planar surfaces spaced apart to define a block thickness; opposing and parallel first and second faces spaced apart to define a block depth; and opposing first and second side surfaces spaced apart to define a block width, the first and second side surfaces together with the upper and lower surfaces and the first and second faces defining a block body, the first and second side surfaces converging from the first face to the second face such that a width of the block at the first face is greater than a width of the block at the second face, the block body having a circular core extending between the upper and lower surfaces, the core having a radius r, each of the first and second side surfaces having a curvilinear recess having a radius of curvature r', where r equals r', each of the side surfaces further having at least one slot extending between the upper and lower surfaces and at least one projection extending between the upper and lower surfaces. The wall block further includes the block body being configured such that when the wall is constructed from a plurality of the wall blocks arranged in multiple courses in a running bond pattern, the front surface of the wall may be constructed from either the first or second faces of the plurality of wall blocks or a combination thereof, curvilinear recesses of adjacent blocks in a course form an opening which aligns vertically with cores in blocks in adjacent courses and the at least one projection of blocks in a course are received in the at least one slot of adjacent blocks of the course.

The wall block may further include at least one of the first and second faces being textured and at least one of the first and second faces has a beveled perimeter while including side surfaces that may not be textured. The r and r' of the wall block may be in the range of 1½ inches to 2 inches. The slots and projections of the wall block may have a cross-sectional shape which is selected from curvilinear and rectilinear.

In another aspect the present invention is a wall block system for use in forming a wall from multiple wall blocks, the wall having a front surface and a rear surface, the wall block including a plurality of blocks including first and second blocks, each block having opposing and parallel upper and lower surfaces spaced apart to define a block thickness, opposing and parallel first and second faces spaced apart to define a block depth, opposing first and second side surfaces spaced apart to define a block width, the first and second side surfaces together with the upper and lower surfaces and the first and second faces defining a block body, each of the side surfaces having at least one slot extending between the upper and lower surfaces, the slot defining a longitudinal opening at the side surface and an interior cavity, the interior cavity having a width which is greater than a width of the opening of the slot. The wall block also includes a plurality of elongate connectors including a first elongate connector, each elongate connector having first and second end portions and an intermediate portion, the first and second end portions being configured such that when the wall is constructed from a plurality of the wall blocks including the first and second wall blocks arranged side-by-side in a course of blocks the first end portion of the first elongate connector is accommodated within a cavity of the first block and the second end portion of the first connector is accommodated within a cavity of the second block to thereby lock the first and second blocks together in the wall.

The wall block system may further include at least one of the first and second faces of the wall block being textured and at least one of the first and second faces having a beveled perimeter while including side surfaces that may not be textured. The plurality of elongate connectors of the wall block system may be bow-tie shaped in transverse cross-section and the end portions of the plurality of elongate connectors may have laterally extending projections. The first and second side surfaces of each block of the wall block system may also converge from the first face to the second face such that a width of the block at the first face is greater than a width of the block at the second face.

The block body of each block of the wall block system may also include a circular core extending between the upper and lower surfaces, the core having a radius r and the first and second side surfaces of each block may additionally have a curvilinear recess having a radius of curvature r'. The wall blocks of the wall system may also have r equal to r' and may be in the range of 1½ inches to 2 inches.

BRIEF DESCRIPTION OF THE DRAWINGS

FIGS. 2A and 2B illustrate perspective and bottom views respectively, of a first embodiment of a second retaining wall block of this invention. FIG. 2C illustrates a perspective view of a block connector used in a wall system constructed of the wall block of FIGS. 2A and 2B.

DETAILED DESCRIPTION OF PREFERRED EMBODIMENTS

In this application, "upper" and "lower" refer to the placement of the block in a wall. The lower or bottom surface is placed such that it faces the ground. In a wall, one row of blocks is laid down, forming a course. An upper course is formed on top of this lower course by positioning the lower surface of one block on the upper surface of another block. If the blocks in each course are vertically aligned to form parallel vertical columns of blocks the resulting wall has a stacked bond pattern. If the blocks in each course are vertically offset the wall has a running bond pattern.

This invention comprises blocks that are used together in the construction of a wall. The blocks are configured to be compatible with each other in the construction of a retaining wall, a parapet wall, and a free-standing wall. Such walls may be straight, curved, or circular. Although not a requirement of this invention, each block may have at least one face that is textured in a manner resulting in the appearance of natural stone. When at least two faces of the block have been textured, the orientation of the faces may be reversed so that either the front or the back of the block may serve as an exposed face. Preferably, there is a natural-appearing finish on all exposed sides of the wall. The wall system is designed to be structurally sound and easy to install. The wall system is especially useful in constructing smaller walls having a height of about 3 feet or less.

Blocks may also be provided with a side connection system wherein a side of the block is provided with a channel or slot that is configured to engage a corresponding projection on an adjacent block. There may be one or more channels or slots (and corresponding projections) on the block. Typically, and preferably, the side connection system is used on a smooth, untextured side of the block. The side connection system is a particular advantage in the construction of free-standing walls. This is because the side connection further stabilizes the wall and because the slots and projections prevent light from showing through the wall and together provide for a close fit of the blocks in the wall.

Figure 1A:
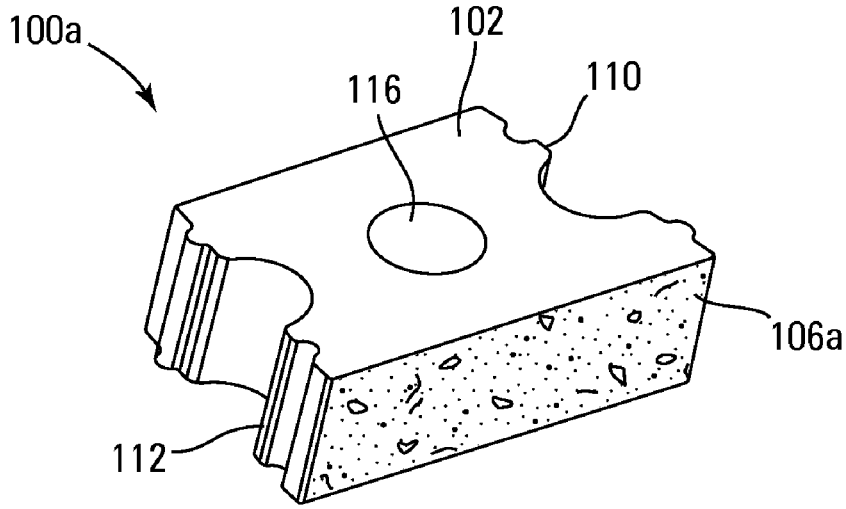
FIGS. 1A and 1B illustrate perspective and bottom views respectively, of a first embodiment of a first wall block of this invention.
Figure 1B:
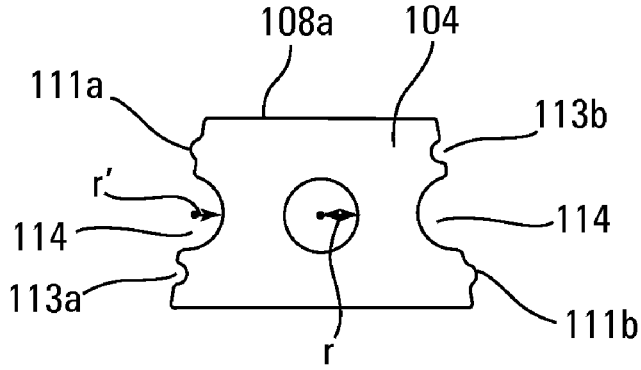

FIGS. 1A and 1B illustrate a first embodiment of a first block 100*a* of this invention. FIG. 1D is a perspective view of a portion of a wall constructed with blocks 100*a*. Block 100*a* comprises lower surface 104 opposed and substantially parallel to upper surface 102, and opposing and substantially parallel first and second (also referred to as front and back) faces 106*a* and 108*a*, respectively. The upper and lower surfaces are separated by the thickness of the block. For the purposes of this description, first face 106*a* is shown facing the viewer in FIG. 1A, however, it is to be understood that the first faces of some blocks and second faces of other blocks are in some situations exposed on the same side of a wall interchangeable when the blocks are used in a wall, for example, as will be described in connection with FIG. 4. The block also comprises opposing and converging side surfaces 110 and 112 (i.e., imaginary lines coincident with side surfaces 110 and 112 will eventually converge at some distance away from the second face or back of block 100*a*) and are separated by the width of the block. The converging side surfaces result in first face 106*a* having a larger surface area than second face 108*a*. Side surfaces 110 and 112 have curvilinear recesses 114. Block 100*a* is shown with lower surface 104 facing up and upper surface 102 facing down in FIG. 1B, however it is to be understood that either the upper surface or the lower surface could be used as the top surface of the blocks when constructing a wall form the blocks. Block 100*a* is provided with core 116 that extends through the thickness of the block. Preferably core 116 is circular.

Block 100*a* can be sized to desired dimensions. For example, the thickness of the block can be 4 inches (10.2 cm), the width of the block can be 12 inches (30.5 cm) along a first face 106*a* and 9⅜ inches (23.8 cm) along the second face 108*a* and the depth of the block between the first and second faces can be 7¾ inches (19.7 cm). The circular core has a radius r and curvilinear recesses have a radius r'. Preferably r equals r'. Typically r and r' will be in the range of 1½ inches (3.8 cm) to 2 inches (5.1 cm).

Utilizing a generally circular core 116 has been found to provide several advantages. A circular core which forms a cylindrical opening through the block can be made quite large in comparison to the total block dimensions without compromising the strength of the block. Further a circular core does not result in the existence of sharp angles being formed within the structure of the block which are more likely to break. Still further, the combination of a circular core and curvilinear side recesses provides an advantage when constructing a wall with a plurality of the blocks. The curvilinear recesses of adjacent blocks in a course of the wall form a cavity with a curvilinear perimeter which may be substantially circular. This cavity aligns with the circular cores of blocks in courses above and below when the wall is constructed in a running bond pattern. This results in the formation of a plurality of vertical columnar cavities from the top of the wall to the bottom of the wall. The circular shape of the cores and the curvilinear shape of the recesses minimize any overlapping edges in the cavity which could block stabilizing fill material from filling the cavity as discussed below.

Block 100*a* is provided with a side connection system wherein a side of the block is provided with a channel or slot that is configured to engage a corresponding projection on an adjacent block. Side surface 110 has projection 111*a* located proximate to second face 108*a* and slot 113*a* located proximate to first face 106*a*. Side surface 112 has projection 111*b* located proximate to first face 106*a* and slot 113*b* located proximate to second face 108*a*. The shape of the projection and slot are shown as being curvilinear, however it is to be understood that the shape could be rectilinear or another shape. First blocks of this invention could also have both slots located on one side and both projections located on the other side. The block may also be configured to have only one slot/projection on each side or may also be configured to have more than two. Typically, and preferably, the side connection system is used on a smooth, untextured side of the block. This allows for a close fit and tight connection between adjacent blocks as more fully described in connection with FIGS. 3 and 4. The side connection system is a particular advantage in the construction of free-standing walls. This is because the side connection further stabilizes the wall and because the slots and projections prevent light from showing through the wall and together provide for a close fit of the blocks in the wall.

Figure 1C:
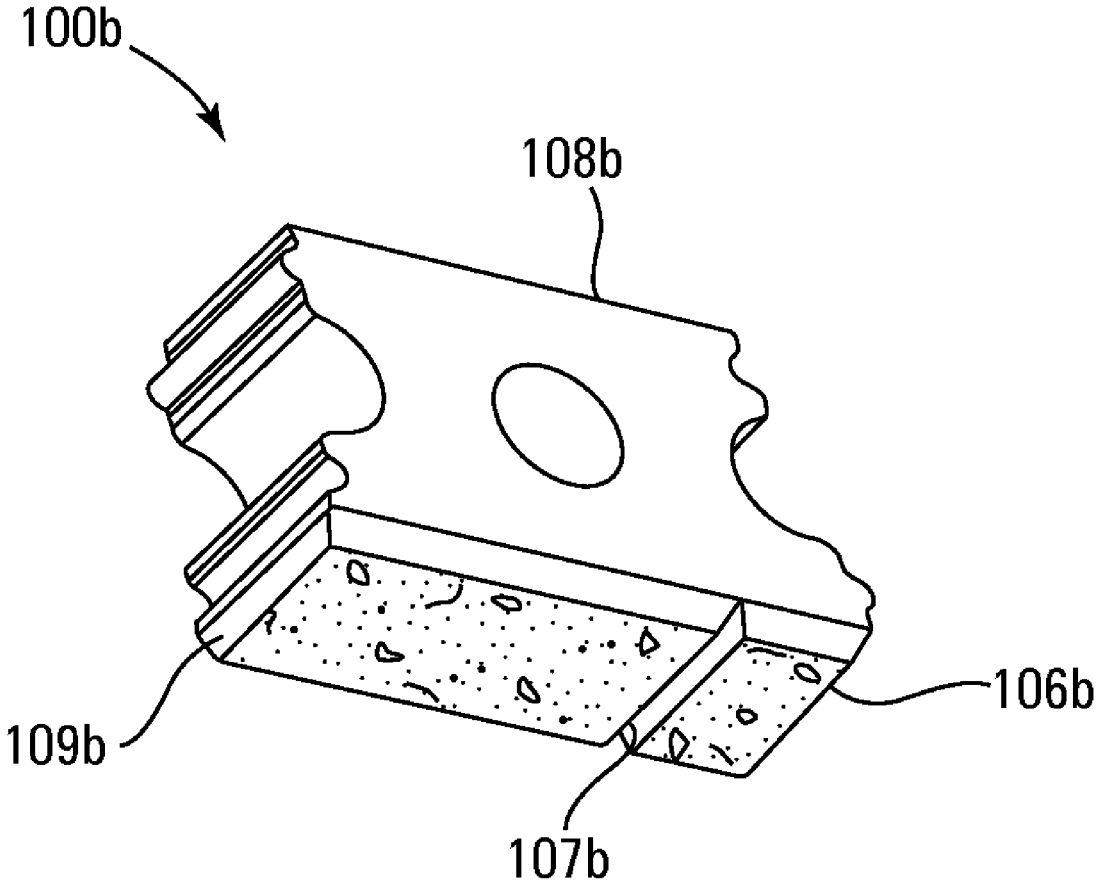
FIG. 1C illustrates a perspective view of an alternate embodiment of the first wall block of this invention.
Figure 1D:
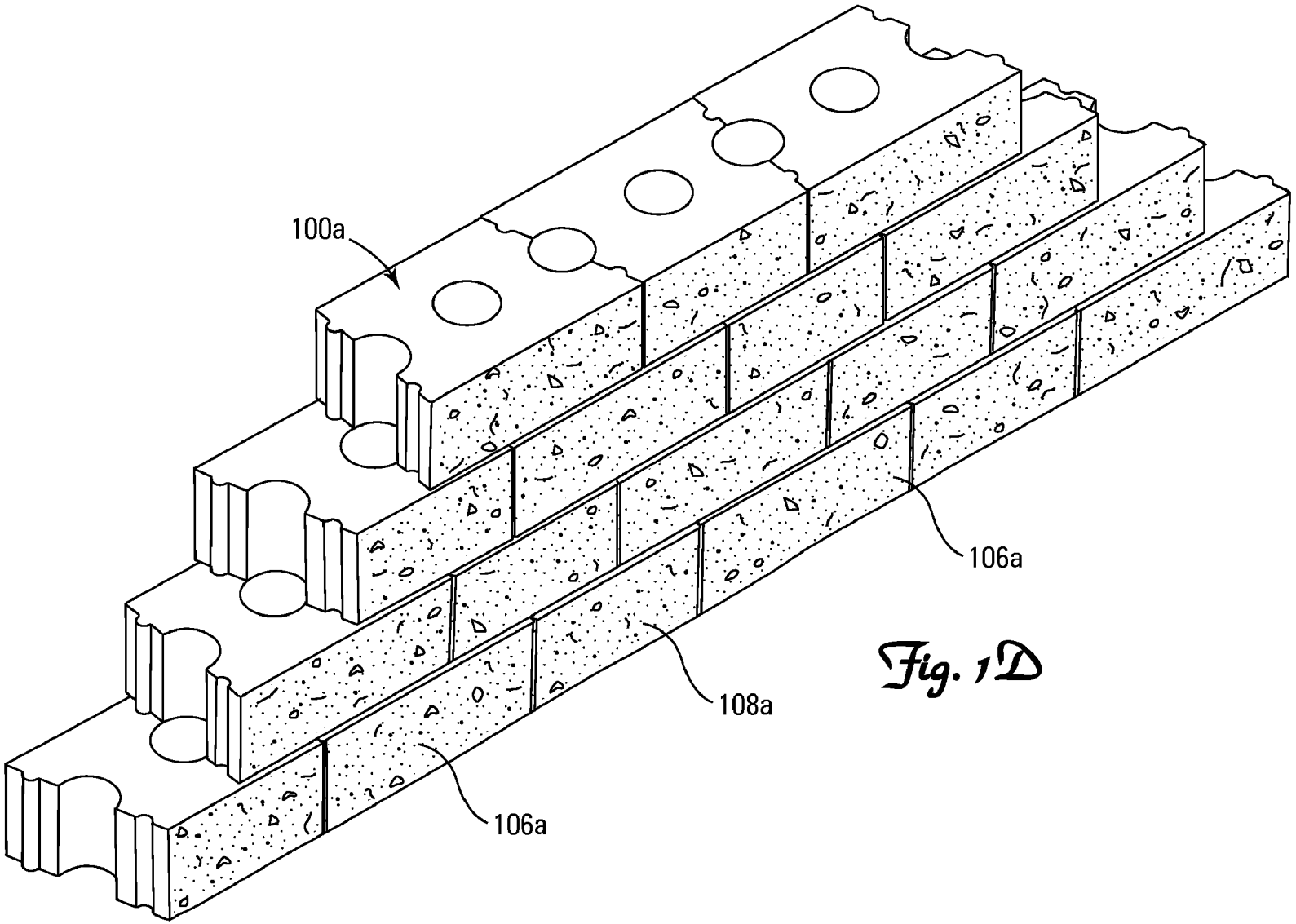
FIG. 1D is a perspective view of a portion of a wall constructed with the block of FIGS. 1A and 1B.

FIG. 1C illustrates an alternate block embodiment. Block 100*b* as illustrated in FIG. 1C is substantially similar to block 100*a*. First and second faces 106*b* and 108*b* have been given a beveled perimeter 109*b* and a notch 107*b*. It is to be understood that the bevels 109*b* and notch 107*b* could be placed on one or both of the faces. It is also to be understood that the faces may be given just the bevels or just a notch and not a combination of both features. The bevels and notch provide for the formation of a multisized and random block pattern on the exposed wall surface. In an alternate block embodiment faces of the block could also be given an imprinted texture. It is to be understood that the imprinted texture could be placed on one or both of the faces.

FIGS. 2A and 2B illustrate a first embodiment of a second block of this invention. Block 200 comprises lower surface 204 opposed and substantially parallel to upper surface 202, and opposing and substantially parallel first and second (also referred to as front and back) faces 206 and 208, respectively.

The block also comprises opposing and converging side surfaces 210 and 212 (i.e., imaginary lines coincident with side surfaces 210 and 212 will eventually converge at some distance away from the back of block 200) and are separated by the width of the block. The converging side surfaces result in first face 206 having a larger surface area than second face 208. Side surfaces 210 and 212 have curvilinear recesses 214. Block 200 is shown with lower surface 204 facing up and upper surface 202 facing down in FIG. 2B, however it is to be understood that the upper and lower surfaces are interchangeable when used in a wall. The upper and lower surfaces are separated by the thickness of the block. Block 200 is provided with core 216 that extends through the thickness of the block.

Figure 5:
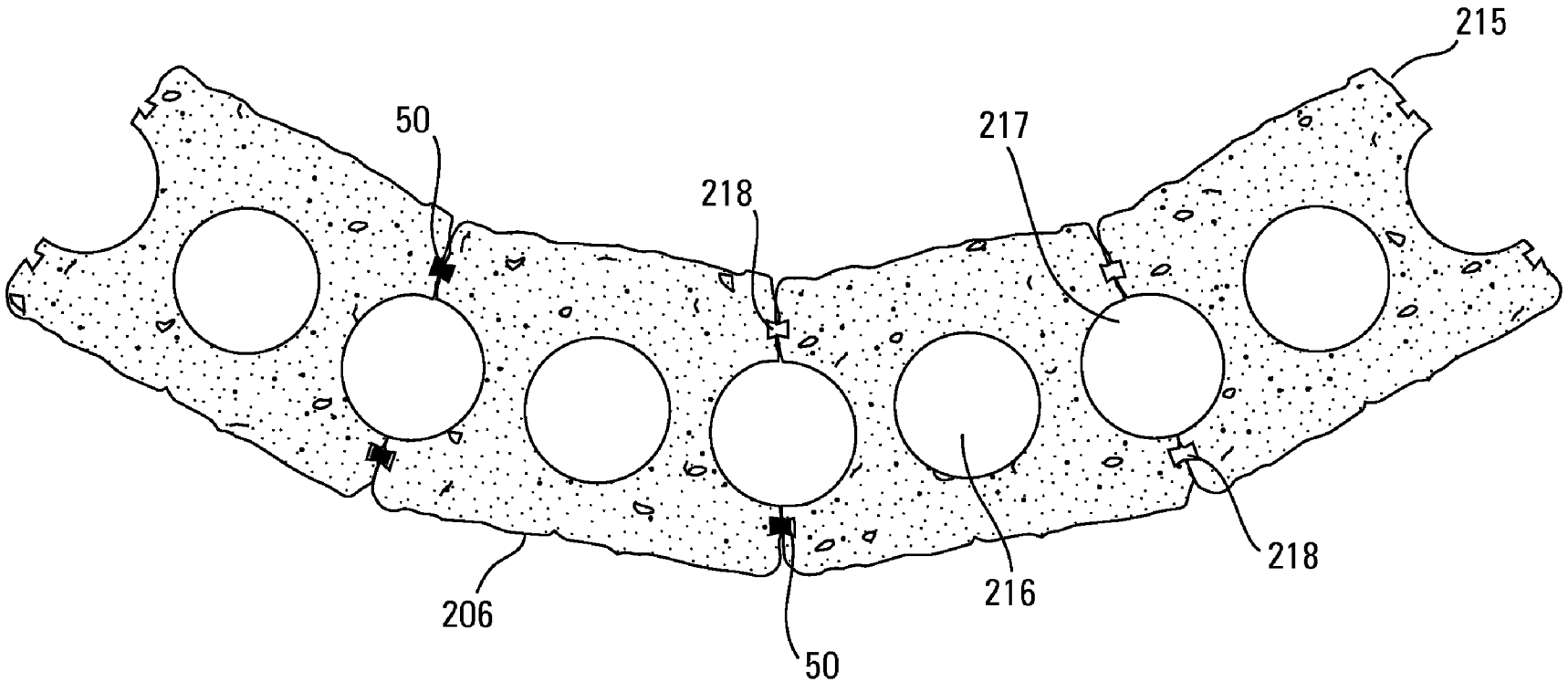
FIG. 5 illustrates a top view of a curvilinear wall made with the wall blocks of FIGS. 2A and 2B.

Block 200 is provided with a side connection system wherein the side surfaces 210 and 212 of the block are provided with at least one channel or slot 215 and are configured to align with a corresponding channel or slot on an adjacent block. As best seen in FIG. 5 this alignment produces a connector receiving cavity 218 that is configured to receive a connector 50 as shown in FIG. 2C. Connector 50 has a bow-tie shape with a number of friction projections 54 located on the shaft 52. These friction projections increase the surface area of the connector and help to secure the connector into the cavity, thus reducing the amount of movement of the blocks relative to one another. The connector may be an injection molded part made of a compressible material such as plastic. The compressible material should not be brittle but pliable to enable a firm compression friction fit of the connector into the connecting cavity. This will lock the blocks together yet enable adjacent blocks to be flexible and somewhat moveable with respect to each other which is an advantage if there is any movement or slanting of the wall. It should be noted that this side connection system could be used on other types of wall blocks and wall block systems for constructing various walls and other structures.

The blocks of either embodiment are made of a rugged, weather resistant material, preferably (and typically) zero-slump molded concrete. Other suitable materials include wet cast concrete, plastic, reinforced fibers, wood, metal and stone. Blocks of this invention are typically manufactured of concrete and cast in a masonry block machine. The block's dimensions are selected not only to produce a pleasing shape for the wall, but also to permit ease of handling and installation. Providing a large core (i.e., large relative to the overall block size) is preferred because it results in a reduced weight for the block, thus permitting easier handing during installation of a wall.

Figure 3:
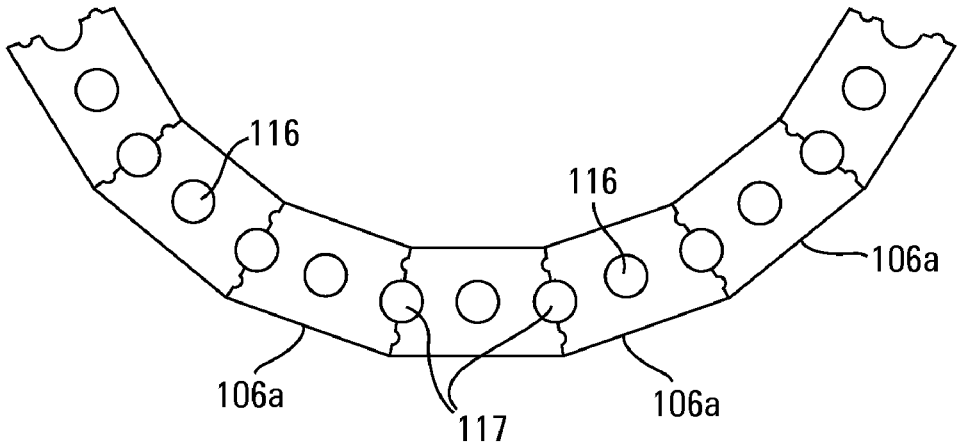
FIG. 3 is a top view of a curvilinear wall made with the wall blocks of FIGS. 1A and 1B.

FIG. 3 illustrates a circular wall made with wall block 100*a* of the present invention. Generally, when constructing a wall a trench is excavated to a pre-selected depth and lined with a level base of granular material such as crushed stone. A base layer is then placed and leveled unto the crushed stone. The blocks are placed side to side with first face 106*a* facing outward. The adjacent block is placed and the projection and slot of the side of one block fits securely into the slot and projection of the adjacent block. This interlocks adjacent blocks in a course giving the wall more stability without the use of pins and pin receiving apertures typically found in prior art block systems. Once the base layer is laid, subsequent layers are placed one on top of the next until the desired height is reached. Once the desired height is reached a capping layer may be added. Typically, the placement of blocks are vertically offset in adjacent courses in a running bond pattern. Curvilinear recesses 114 of side surfaces 110 and 112 form substantially circular cavities 117 when laid side to side and are substantially similar in size and shape to core 116. The cores and cavities overlap one another in adjacent courses producing vertical columnar cavities inside the wall structure. The circular shape of the cores and cavities helps to maximize the alignment and functional volume of the vertical cavity. These columnar cavities may be filled with a stabilizing material such as sand, gravel, sheer resistant fill (i.e. crushed stone), concrete, cement or the like, to give the wall added stability. The interlocking projections and slots along with the stabilizing material added to the vertical columnar cavities stabilize the wall making it structurally sound without the use of traditional stabilizing systems such as pins and the like. Optionally, construction adhesive may be used to lack blocks and/or courses together with or without the use of stabilizing materials.

Figure 4:
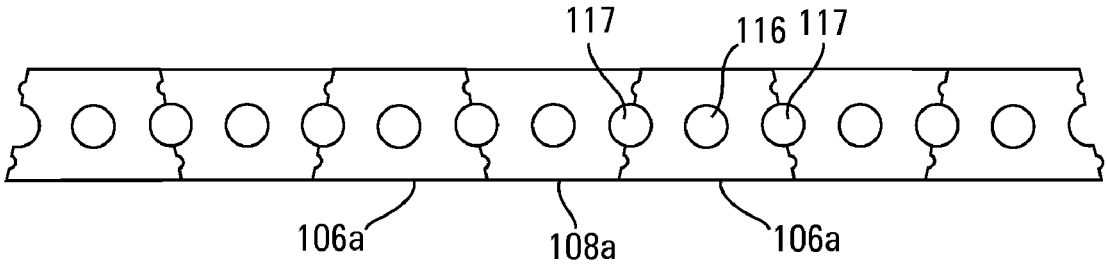
FIG. 4 is a top view of a straight wall made with the wall blocks of FIGS. 1A and 1B.

FIG. 4 illustrates a straight wall made with wall blocks 100*a* of the present invention. A straight wall is produced by alternating the placement of the first and second faces of blocks relative to each adjacent block (i.e. first face 106*a* of a block is placed projecting outward and then the second face 108*a* of an adjacent block is placed projecting outward). The adjacent block is placed and the projections and corresponding slots of each block secures the blocks to one another. This interlocks the blocks together giving the wall more stability without the use of pins and pin receiving apertures.

FIG. 5 illustrates a circular wall made with block 200 of the present invention. A trench is excavated to a pre-selected depth and lined with a level base of granular material such as crushed stone. A base layer is then placed and leveled unto the crushed stone. The blocks are placed side to side with first face 206 facing outward. When adjacent blocks have been laid side to side, slots 215 of each adjacent block align and form connector receiving cavity 218. Connector 50 is then placed into the cavity 218 securing the side of one block to the adjacent side of a second block. Curvilinear recesses 214 of side surfaces 210 and 212 form cavities 217 when laid side to side and are substantially similar in size and shape to core 216. The cores and cavities overlap on another with each staggered course producing vertical columnar cavities inside the wall structure. These columnar cavities may be filled with a stabilizing material such as sand, gravel, sheer resistant fill (i.e. crushed stone), concrete cement or the like to give the wall added stability. The connectors and connector cavities form a side connection system. This system along with the stabilizing material added to the vertical columnar cavities supports the wall making it structurally sound.

Although particular embodiments have been disclosed herein in detail, this has been done for purposes of illustration only, and is not intended to be limiting with respect to the scope of the claims. In particular, it is contemplated that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A wall block system for use in forming a wall from multiple wall blocks, the wall having a front surface and a rear surface, the wall block comprising:

a plurality of blocks including first and second blocks, each block having opposing and parallel upper and lower surfaces spaced apart to define a block thickness, opposing and parallel first and second faces spaced apart to define a block depth, opposing first and second side surfaces spaced apart to define a block width, the first and second side surfaces together with the upper and lower surfaces and the first and second faces defining a block body, the first and second side surfaces converging from the first face to the second face such that a width of the block at the first face is greater than a width of the block at the second face, the block body having a circular core extending between the upper and lower surfaces, the core having a radius r, each of the first and second side surfaces having a curvilinear recess having a radius of curvature r', where r equals r', each of the side surfaces having at least one slot extending between the upper and lower surfaces, the slot defining a longitudinal opening at the side surface and an interior cavity, the interior cavity having a width which is greater than a width of the opening of the slot; and a plurality of elongate connectors including a first elongate connector, each elongate connector having first and second end portions and an intermediate portion, the first and second end portions being configured such that when the wall is constructed from a plurality of the wall blocks including the first and second wall blocks arranged side-by-side in a course of blocks the first end portion of the first elongate connector is accommodated within a cavity of the first block and the second end portion of the first connector is accommodated within a cavity of the second block to thereby lock the first and second blocks together in the wall.

2. The wall block system of claim 1 wherein at least one of the first and second faces of each block is textured.

3. The wall block system of claim 1 wherein the side surfaces of each block are not textured.

4. The wall block system of claim 1 wherein r and r' are in the range of 1½ inches to 2 inches.

5. The wall block system of claim 1 wherein at least one of the first and second faces of each block has a beveled perimeter.

6. The wall block system of claim 1 wherein each of the plurality of elongate connectors is bow-tie shaped in transverse cross-section.

7. The wall block system of claim 1 wherein the end portions of the plurality of elongate connectors have laterally extending projections.

* * * * *